US007055279B2

(12) United States Patent
Flores

(10) Patent No.: US 7,055,279 B2
(45) Date of Patent: Jun. 6, 2006

(54) APPARATUS AND METHOD FOR CLEANING PAINTBALL GUNS

(76) Inventor: Jimmy Flores, 19528 Ventura #328, Tarzana, CA (US) 91356

( * ) Notice: Subject to any disclaimer, the term of this patent is extended or adjusted under 35 U.S.C. 154(b) by 127 days.

(21) Appl. No.: 10/764,033

(22) Filed: Jan. 24, 2004

(65) Prior Publication Data

US 2005/0178039 A1 Aug. 18, 2005

(51) Int. Cl.
*F41A 29/00* (2006.01)

(52) U.S. Cl. ..... 42/95

(58) Field of Classification Search ..... 42/95, 42/90

See application file for complete search history.

(56) References Cited

U.S. PATENT DOCUMENTS 3,064,294 A * 11/1962 Stocking ..... 15/104.19
4,698,932 A * 10/1987 Schneider ..... 42/95
5,987,799 A * 11/1999 Dedeaux et al. ..... 42/90

* cited by examiner

*Primary Examiner*—J. Woodrow Eldred
(74) *Attorney, Agent, or Firm*—Bay Area IP, LLC; Ariel Bentolila

(57) ABSTRACT

A device and method for cleaning an inside barrel of a paint ball gun is provided. The cleaning device comprises a compressible cleaning tip configurable to have a smaller diameter than the inside barrel in response to a compression member, the tip being mounted to an end of an elongated tube. The inside of the paintball gun barrel is cleaned by inserting the cleaning device while compressed, and retracting it in its decompressed state.

16 Claims, 7 Drawing Sheets

(b)

(a)

(b)

APPARATUS AND METHOD FOR CLEANING PAINTBALL GUNS

FIELD OF THE INVENTION

The present invention relates generally to the field of paintball equipment and, more particularly, pertains to cleaning devices used in removing from the barrel of a paintball gun residual paint deposits left from previously ruptured paintballs.

BACKGROUND OF THE INVENTION

The game of paintball has enjoyed great success in recent years and is a game in which two or more teams try to capture one another's flags. The players on each of the teams each carry a $CO_2$ powered gun that shoots paintballs that are propelled by short bursts of the pressurized gas. Typically, paintballs are gelatin covered, spherical capsules having a diameter of approximately 11/16 of an inch that contain a colored liquid, and typically cannot withstand significant compression without breaking. When a player is hit with a paintball from an opponent's gun, the paintball ruptures and leaves a colored mark on the hit player who then must leave the game.

As the game of paintball has grown in sophistication, semi-automatic paintball guns, guns that sequentially fire paintballs as fast as the trigger can be repeatedly pulled by the user, have become more prevalent. A high firing rate capacity of semi-automatic paintball guns results in the occasional rupture or breakage of paintballs which leave shell or capsule particles and filler paint deposits on the inside surface of a paintball gun barrel. If there are paint deposits on the gun barrel, the next ball will likely be crushed and broken upon its leaving the barrel. Such deposits negatively affect the performance of the paintball gun.

The cleaning of the inside surface of the paintball gun barrel typically involves using a rod-like cleaning device such as disclosed in U.S. Design Pat. No. 393,115 issued Mar. 31, 1998 to Bell et al. One end of this device is provided with a series of spaced apart, disc-like wiping elements such that it is inserted into the barrel of the paintball gun and pulled through to expel the build up of deposits inside the barrel. This type of cleaning process is not ideally effective during paintball competition because it pushes residual paint back into the gun breech, which is where the paintballs are dropped into the barrel. Moreover, known cleaner designs come in varying lengths, which forces the player to buy two or more cleaners to properly fit the barrel length of their particular paintball guns.

In view of the foregoing, there is a need for improved techniques for remove residual paint deposits from paintball gun barrels; in particular, there is a need for an approach that does not push paint into the gun's breech, and also efficiently accommodates various gun barrel lengths. Such a paintball barrel residual paint remover should be cost effective, highly portable, and very convenient to use.

BRIEF DESCRIPTION OF THE DRAWINGS

The present invention is illustrated by way of example, and not by way of limitation, in the figures of the accompanying drawings and in which like reference numerals refer to similar elements and in which.

Figure 1:
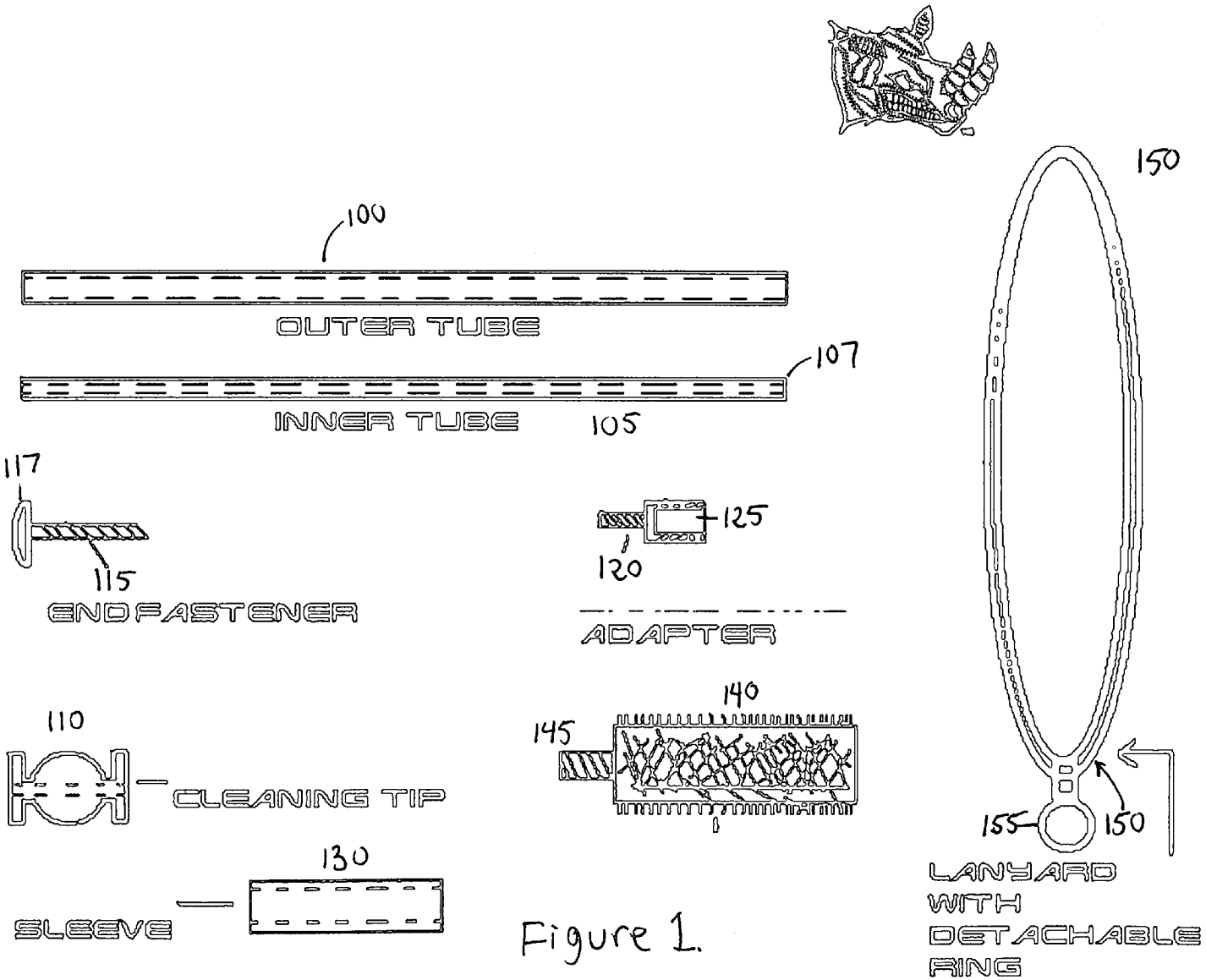
FIG. 1 illustrates the components used to build an embodiment of the present invention.

The above referenced illustrations are not necessarily drawn to scale.

SUMMARY OF THE INVENTION

To achieve the forgoing and other objects and in accordance with the purpose of the invention, a technique to remove residual paint deposits from paintball gun barrels is described.

In one embodiment, a paint ball gun cleaning device for cleaning an inside barrel of a paint ball gun is set fort that comprises an outer tube having a first end and a second end where the diameter of the outer tube is configured to permit the outer tube to be inserted and removed along the length of the inside barrel of the paint ball gun. An inner tube having a first end and a second end, and sized appropriately, is inserted along the length of the outer tube. A compressible cleaning tip having a smaller diameter than the inside barrel is used in conjunction with a cleaning tip compression member which constrains the position of the compressible cleaning tip in the proximity of the first end of the outer tube, the cleaning tip compression member used to induce a compression state change in the first compressible cleaning tip when the inner tube is moved relative to the outer tube, thereby selectively inducing the non-compressed state and the compressed state.

In another embodiment the above described device also includes a cleaning tip adaptor member that is joined with the inner tube on one end, and a second compressible cleaning tip for cleaning the inside barrel on the other end.

Other embodiments include a removable protective sleeve that substantially prevents harmful contact with the inside barrel and provides some degree of rigid support between the cleaning tip adaptor member and the second compressible cleaning tip.

In yet other embodiments of the present invention, the paint ball gun cleaning device includes at least one flexible but sufficiently rigid section in its inner and outer tubes that permit the paint ball gun cleaning device to flexibly fold but otherwise be stiff enough to be pushed through the inside barrel when not folded.

In some embodiments, the paint ball gun cleaning device according to the present invention have an outer tube and inner tube that are made of a malleable material that may be cut to an arbitrary length using common cutting tools.

A method to clean an inside barrel of a paint ball gun in accordance with the present invention is shown, which method includes the steps of inserting into the inside barrel a non-compressed compressible cleaning tip until ready to begin the cleaning process, whereby the compressible cleaning tip is compressed and retracted. While the compressible cleaning tip is compressed and retracted it removes residual paint in the direction of the retraction and out of the gun barrel.

Other features, advantages, and object of the present invention will become more apparent and be more readily understood from the following detailed description, which should be read in conjunction with the accompanying drawings.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments.

Referring to FIG. 1, the components to construct an embodiment of the present invention are shown by way of example, where a brief description immediately follows, and detailed description is presented thereafter. In the Figure, an outer tube 100 and an inner tube 105 with an end section 107 are shown. These components form the main structure where the inner tube 105 is inserted inside of the outer tube 100, which structure receives on one end a cleaning tip 110 held in place by fastener 115, and receives on the opposite end an adapter 120, with protective sleeve 130, and swab 140. Fastener 115 includes a wider end section herein referred to as fastener end 117. A lanyard 150 is available to removably secure the completed device to the user, while still being able to slide freely along outer tube 100.

Figure 2:
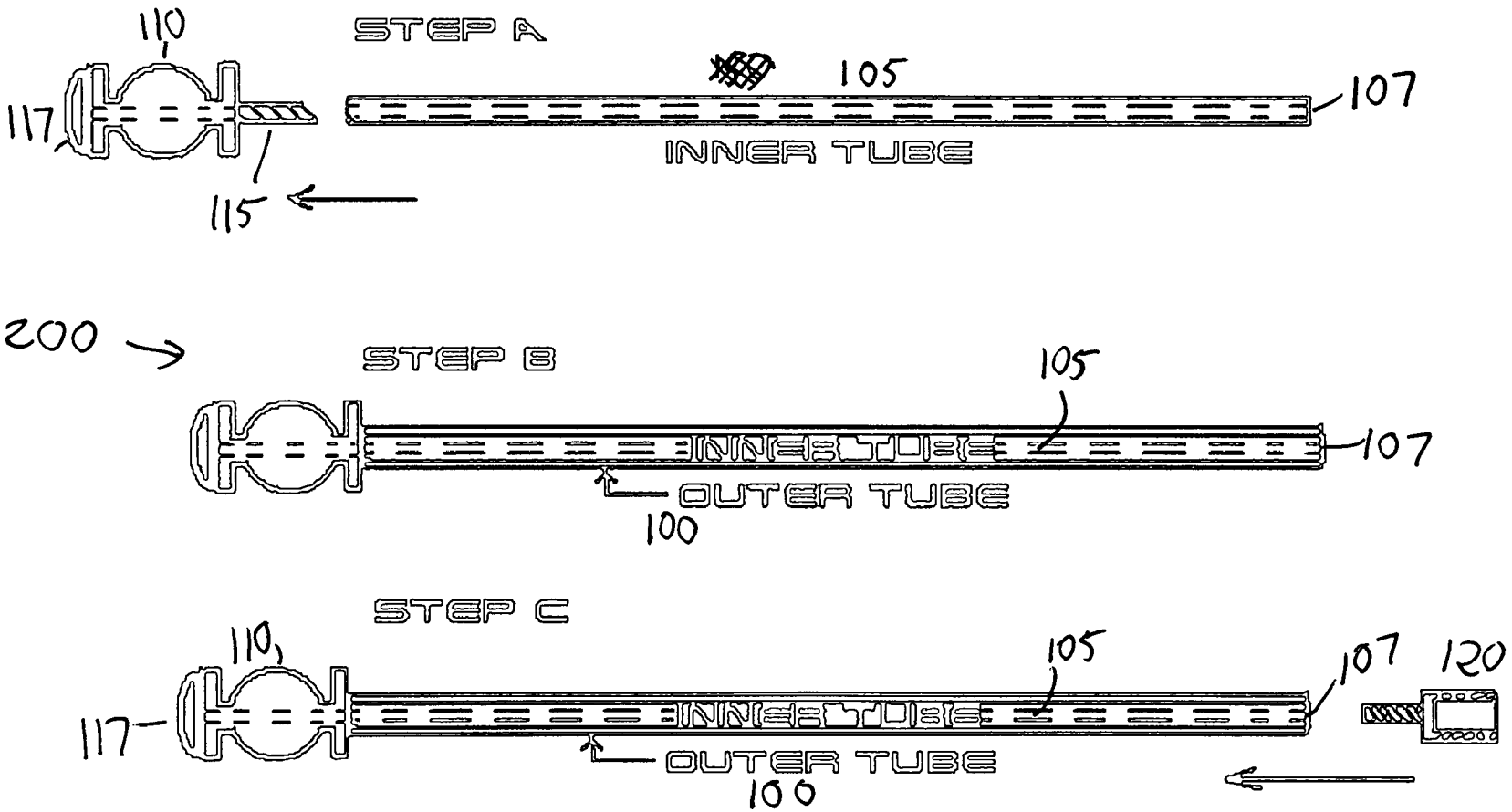
FIG. 2 demonstrates a cross-sectional view of multiple embodiments of the present invention.

A detailed description of a way to construct an embodiment of the present follows. FIG. 2 demonstrates the initial step, STEP A, of attaching cleaning tip 110 to inner tube 105 by way of fastener 115. In this example, cleaning tip 110 is configured to have a central hole sized to allow fastener 115 to be movably inserted through cleaning tip 110 and is long enough to penetrate through both cleaning tip 110 and into an end section of inner tube 105. Fastener 115 is fixed to inner tube 105 by known means, for example, epoxy glue, or being screwed in. Outer tube 100 is then slid over inner tube 105 as shown in STEP B of the Figure. The paint cleaner assembly 200 of this intermediate construction represents a minimal configuration of the present invention for some embodiments as will be made clear in detail below. In short, outer tube 100 presses against the end of cleaning tip 110 opposite from fastener end 117. Fastener end 117, via its attachment to inner tube 105, may be pulled in relative to outer tube 100 thereby providing a compression force onto cleaning tip 110. Hence, although it is anticipated that there are many known ways to configure fastener 115 and inner tube 105, some known practical considerations should be preferably met. For example, fastener 115 should preferably be joined to inner tube 105 with a bond that is sufficiently strong to withstand a high number of compression cycles on cleaning tip 110. Similarly, fastener 115 should preferably be strong enough to withstand a high number of compression cycles on cleaning tip 110.

It should be further understood that there are many known ways to actuate the compression of cleaning tip 110 in paint cleaner assembly 200 as described above. In alternative embodiments of the present invention, it is anticipated that depending on the particular application, a multiplicity of known attachments may be connected to end section 107 by known techniques thereby conveniently enabling a user to pull in fastener end 117 to compress cleaning tip 110. It is also anticipated that although it is shown that outer tube 100 and inner tube 105 have the same length, some embodiments may design inner tube 105 to extend beyond outer tube 100 (not shown) thereby permitting a user to pull directly on end section 107 without the need of additional attachments.

Although the operating principles of the present invention are described in detail below by way of an embodiment with an exemplar attachment to end section 107, conceptually paint cleaner assembly 200, according to the principles of the present invention, is designed small enough to be inserted into the barrel of paint ball gun without significantly making contact with the inner surface of the gun barrel until the user retracts inner tube 105 to compress cleaning tip 110, which expands against the inner surface of the gun barrel and effects the removal of residual surface paint as paint cleaner assembly 200 is retracted from the gun barrel.

Figure 3:
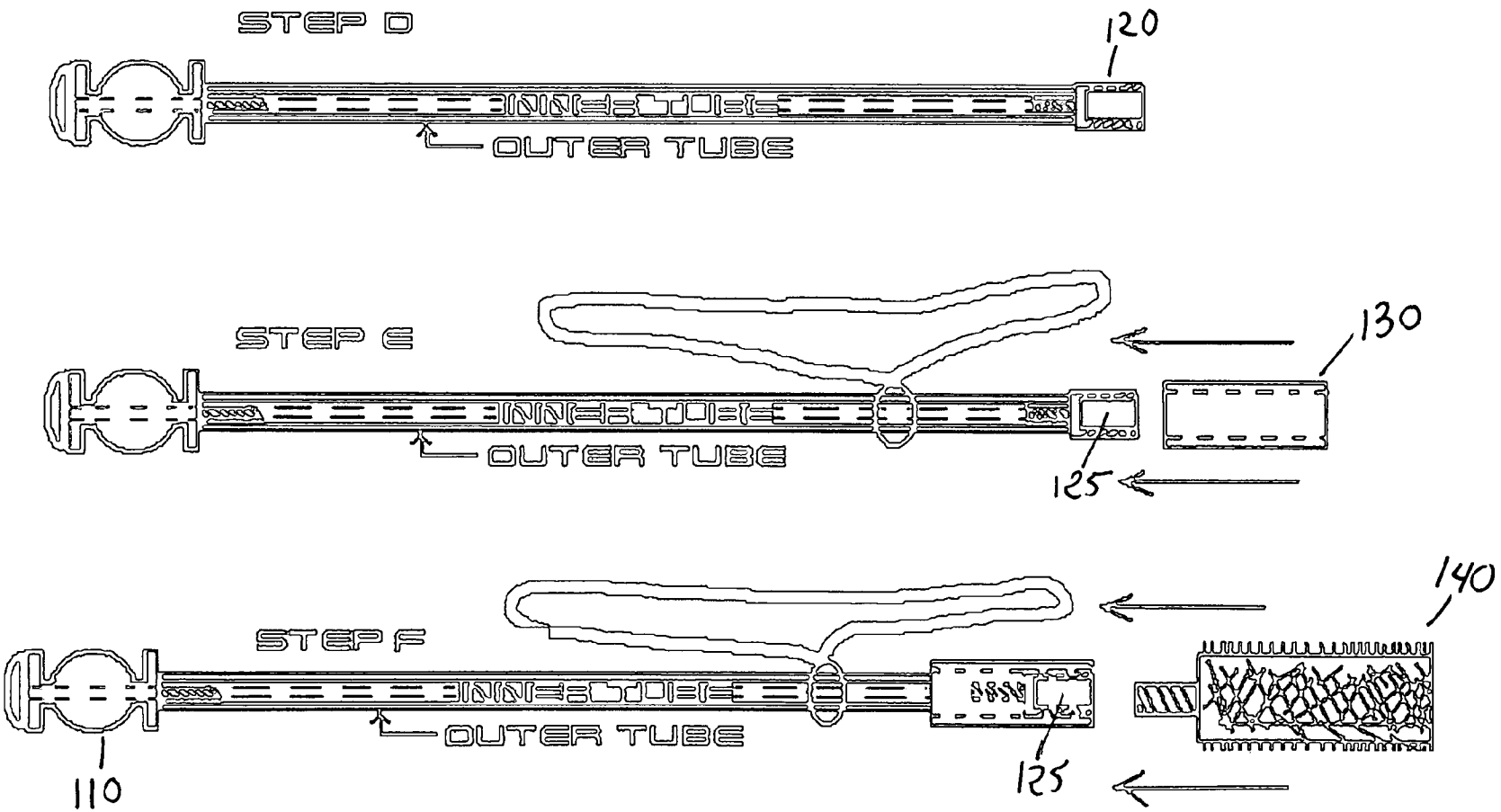
FIG. 3 demonstrates a cross-sectional view of yet other embodiments of the present invention.

Still referring to FIG. 2, STEP C illustrates the making of an alternative embodiment of the present invention where an example of an attachment, adapter 120, and its assembly is shown, whereby a male end of adapter 120 is inserted into and fixed to end section 107, by being screwed in for example, as shown in STEP D of FIG. 3. Adapter 120, as shown in the present embodiment, has an exposed end that is suitable to receive a multiplicity of end attachments designed for the particular application, and serve the dual use of providing a gripping mechanism to actuate the compression of cleaning tip 110 during paint removal from paintball gun barrels. Adapter 120 may be constructed from any material that serves the described purpose, where, by way of example, brass is a suitable choice for robust performance.

In another alternative embodiment, as shown in STEP E of FIG. 3, protective sleeve 130 is placed to sufficiently cover adapter 120 thereby minimizing the risk of scratching the inside surface of the paintball gun barrel. Protective sleeve 130 is preferably made of soft plastic, such as vinyl for example, and held in place by friction so that it can be easily removed when needed. Other known methods of providing a protective barrier as described may be employed. Lanyard 150 is an optional accessory that serves to secure the present invention to the user. In the embodiment shown, lanyard 150 has a detachable ring 155, which ring is placed around outer tube 100 and held from sliding off by adapter 120, or protective sleeve 130, or any attachment fixed to adapter 120. There are many lanyard designs known to those in the art, which designs may be implemented in some embodiments depending on the particular application.

Figure 4:
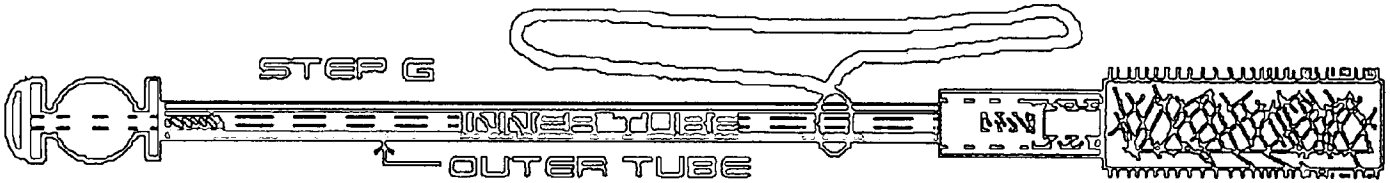
FIG. 4 illustrates a cross-sectional view of a completed device according to an embodiment of the present invention.
Figure 4:
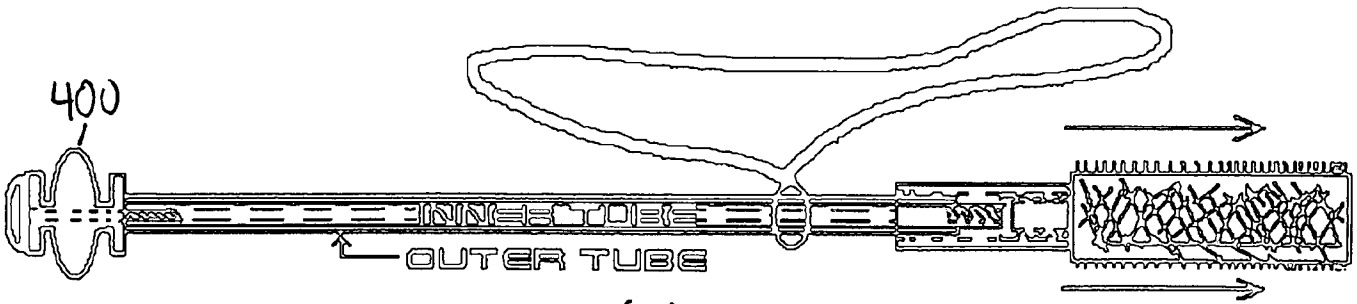

Fixing attachment 140 to adapter 120 as shown in STEP F of FIG. 3 completes the present embodiment. Many known techniques are available to secure attachment 140 to adapter 120, including, for example, by screwing a screw 145 into a threaded female receiving end 125 formed in adapter 120 as shown in FIG. 4(*a*), thereby providing a completed paintball gun barrel cleaning device according to an embodiment of the present invention. In one embodiment of attachment 140, a shotgun swab is used; however, a multiplicity of known attachments is contemplated depending on the application.

To actuate the cleaning mechanism in the present embodiment the user simply pulls attachment 140 in the direction of the arrows shown in FIG. 4(*b*). When actuated, cleaning tip 110 is forced into its compressed state 400, thereby increasing its diameter perpendicular to the lengthwise axis of the outer tube 100.

Figure 5:
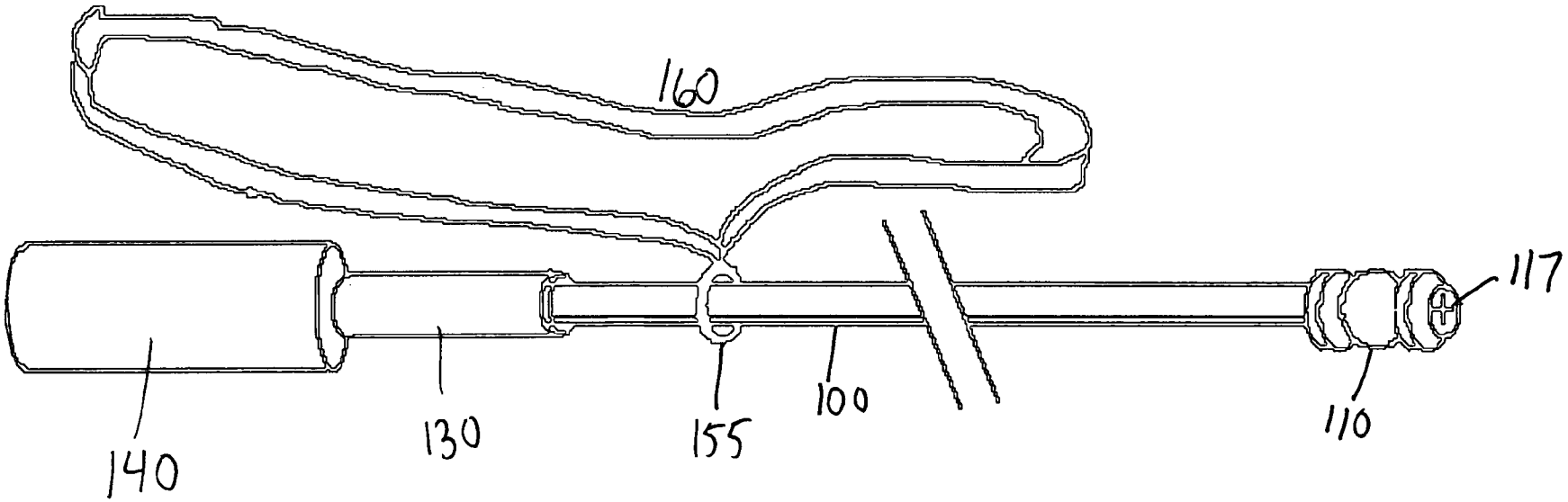
FIG. 5 illustrates a perspective view of the completed device according to an embodiment of the present invention.

To clean the inside barrel of a paint ball gun, the user of the present embodiment would simply insert the present invention into the paintball gun barrel while cleaning tip 110 is in the non-compressed as shown in FIG. 4(*a*). When the user has inserted cleaning tip 110 to the desired depth into the paintball gun barrel, attachment 140 is retracted in the direction of the arrows shown in FIG. 4(*b*) thereby expanding cleaning tip 110 into compressed state 400, which firmly presses against the inside surface of the paintball gun barrel. Continued retraction force keeps cleaning tip 110 in compressed state 400 and acting like a squeegee sweeping away paint in the direction of the retraction until cleaning tip 110 is pulled out of the paintball gun barrel and the residual paint deposits in the paintball gun barrel are removed. FIG. 5 illustrates a perspective view of the embodiment of the present invention shown in FIG. 4(*a*).

Figure 6:
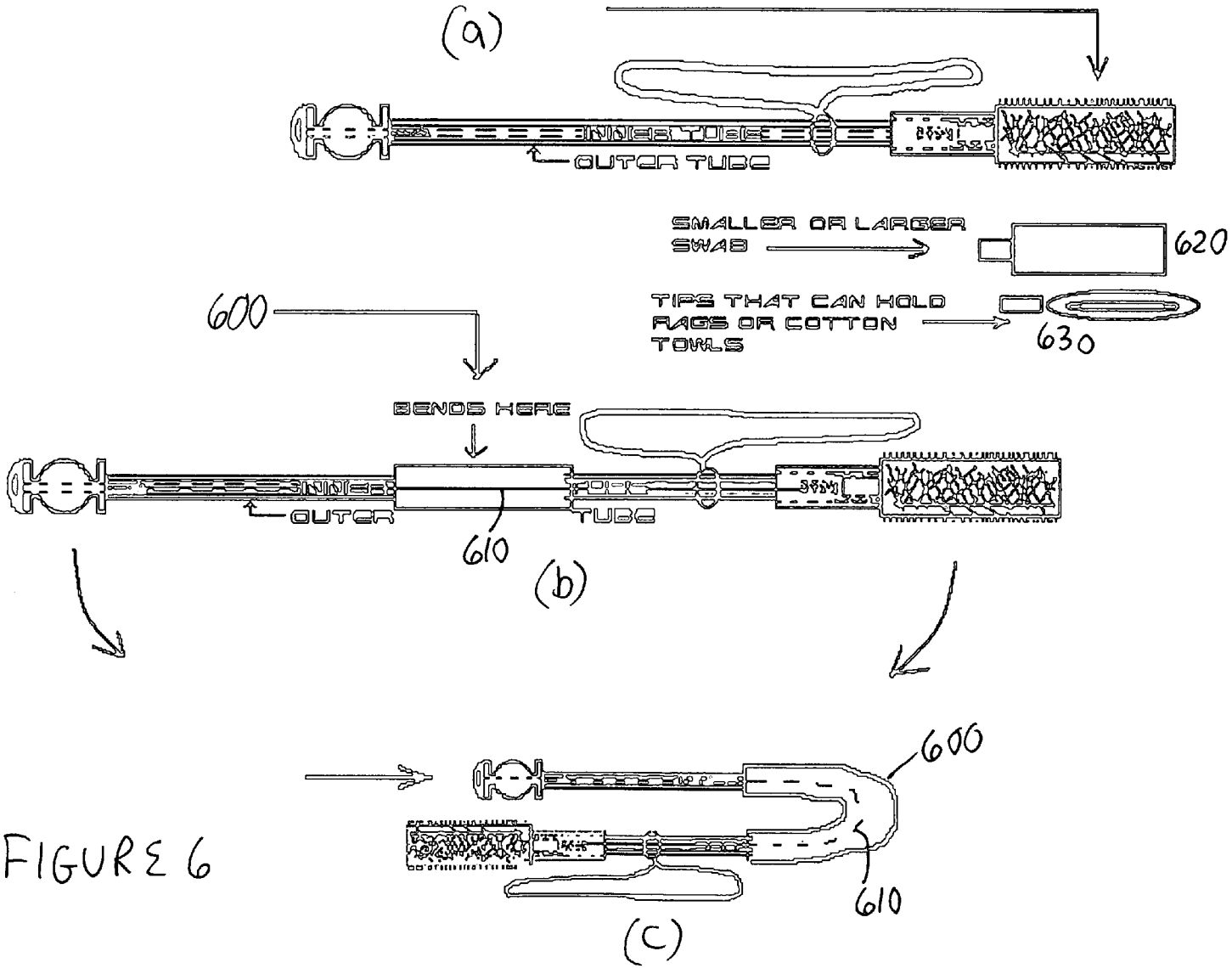
FIG. 6 illustrates various alternative embodiments of the present invention.

Cleaning tip 110 is preferable made out of rubber to provide the desired compressibility and squeegee characteristics described; however, any suitable material known to those in the art may be used. Cleaning tip 110 is preferably sized to be very small to enter the barrel the paintball gun barrel without making substantial contact with the barrel, and yet be large enough to expand to the required diameter, as described above, when compressed. Attachment 140 may be configured as a secondary cleaner adapted to fit known paintball gun barrel cleaners including, for example, any gauge of cotton, cloths, or brushes as shown in FIG. 6(*a*). The optional secondary cleaners further insuring a clean and dry paintball gun barrel. In some embodiments, the application may require various sizes of swab 620, and in yet other applications, an alternative flag tip 630 that can hold flags or cotton may be desired.

When outer tube 100 and inner tube 105 are made from sufficiently soft and malleable plastic, an attendant capability of the present invention is to enable the user to cut, using common cutting tools, outer tube 100 and inner tube 105 to a desired length for a particular paintball gun barrel application. Those in the art will appreciate that the user may readily determine the optimal length required for their particular application.

Yet another alternative embodiment of the present invention is shown in FIG. 6(*b*) where a section 600 of the relatively rigid shafts of outer tube 100 and inner tube 105 is removed and replaced with relatively flexible materials that permit folding as shown in FIG. 6(*c*). For example, section 600 of outer tube 100 is be replaced with flexible surgical tubing and joined to the remaining rigid sections of outer tube 100 by known means, and section 600 inner tube 105 is replaced with a monofilament line joined to the remaining rigid sections of inner tube 105 by known means. Thus, a foldable embodiment of the present invention is achieved, while maintaining all the attendant characteristics and functionality as previously described.

Yet other embodiments according to the present invention are anticipated where the cleaning tip 110 takes on a multiplicity of various forms that achieve the same function and operate according to the principals of the present invention. For example, referring to FIG. 7(*a*), cleaning tip 110 may be replaced with at least one cleaning disc(s) 710 or a balloon, globe like shape 720, depending on the application. Cleaning disc(s) 710, in accordance with the principles of the present invention, perform a similar function as cleaning tip 110, but operate in a somewhat different manner. That is, to clean a gun barrel, the user would first insert cleaning disc(s) 710 into the barrel while in their non-vertical substantially parallel position as shown in the Figure. Each disc can pivot with respect to the axis when inserted into the paintball gun thereby not pushing paint into the breach. Then, in a similar manner as described for cleaning tip 110, the user retracts inner tube 105, thereby pressing outer tube 100 against cleaning disc(s) 710 and forcing it into the vertical position, which results in firm contact between the out edge of cleaning disc(s) 710 and the inside gun barrel. Thus, when cleaning disc(s) 710 gets to the breach upon outward force the discs are then forced to stand in a perpendicular axis and thus causing a tight seal and expelling paint upon the users outward pull. As described for cleaning tip 110, the cleaning disc(s) 710 in the vertical position act as a squeegee sweeping away paint in the direction of the retraction until cleaning disc(s) 710 is pulled out of the paintball gun barrel and the residual paint deposits in the paintball gun barrel are removed.

Figure 7:
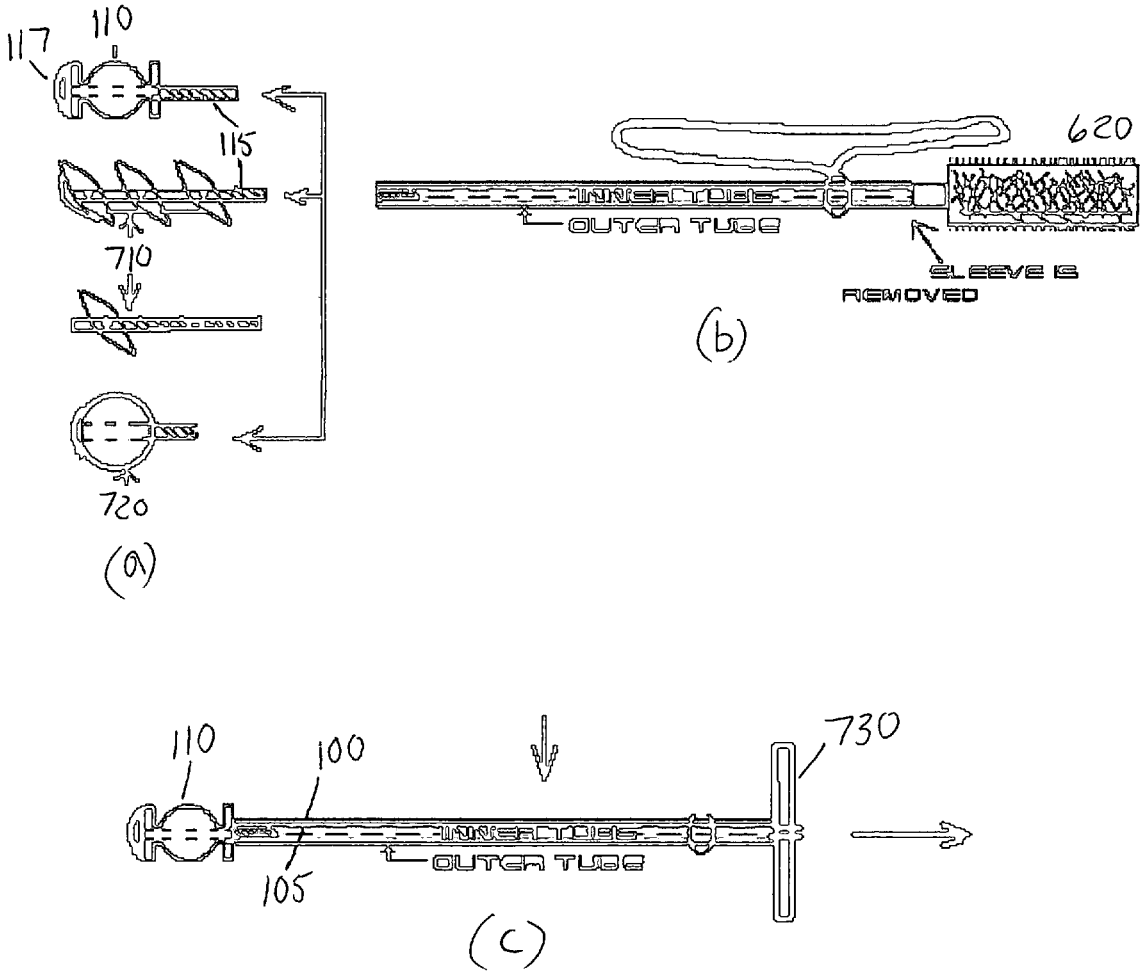
FIG. 7 illustrates additional alternative embodiments of the present invention.

In addition, some embodiments may not have protective sleeve 130 as shown in FIG. 7(*b*). Yet other alternative embodiments may remove swab 620 and replace it with a handgrip attachment 730 (a t-bar handle is shown by way of example) that is used to pull in inner tube 105 thereby compressing cleaning tip 110.

Having fully described at least one embodiment of the present invention, other equivalent or alternative methods of implementing a paintball gun barrel cleaner according to the present invention will be apparent to those skilled in the art. The invention has been described above by way of illustration, and the specific embodiments disclosed are not intended to limit the invention to the particular forms disclosed. The invention is thus to cover all modifications, equivalents, and alternatives falling within the spirit and scope of the following claims.

The invention claimed is:

1. A paint ball gun cleaning device for cleaning an inside barrel of a paint ball gun, the cleaning device comprising:

a. An outer tube having a first end and a second end, wherein the diameter of the outer tube is configured to permit the outer tube to be removabley inserted along the length of the inside barrel of the paint ball gun;

b. An inner tube having a first end and a second end, wherein the diameter of the inner tube is configured to permit the inner tube to be movabley inserted along the length of the outer tube;

c. A first compressible cleaning tip having a smaller diameter than the inside barrel, and further having at least a non-compressed state and a compressed state, the non-compressed state having a corresponding non-compressed diameter, and the compressed state having a corresponding compressed diameter, wherein the compressed diameter is greater than the non-compressed diameter; and d. A cleaning tip compression member having a smaller diameter than the inside barrel, and further having a first end and a second end, wherein the second end of the cleaning tip compression member is in communication with the first end of the inner tube and constrains the position of the first compressible cleaning tip in the proximity of the first end of the outer tube, the cleaning tip compression member is further configured to be in communication with the side of said first compressible cleaning tip that is distal from the inner tube, and may be actuated to induce a compression state change in the first compressible cleaning tip when the inner tube is longitudinally retracted relative to the outer tube, thereby selectively inducing the non-compressed state and the compressed state.

2. The paint ball gun cleaning device of claim 1, further comprising:

e. A cleaning tip adaptor member having a first end and a second end, wherein the first end of the cleaning tip adaptor member is in communication with the second end of the inner tube; and f. A second compressible cleaning tip for cleaning the inside barrel, which second compressible cleaning tip is in communication the second end of the cleaning tip adaptor member.

3. The paint ball gun cleaning device of claim 2, further comprising:

A removable protective sleeve sufficiently covering the cleaning tip adaptor member to substantially prevent harmful contact with the inside barrel and to provide some degree of rigid support between the cleaning tip adaptor member and the second compressible cleaning tip.

4. The paint ball gun cleaning device of claim 3, further comprising a lanyard that is configured to secure the outer tube to a user.

5. The paint ball gun cleaning device of claim 2, wherein the second compressible cleaning tip is a flag or a cotton towel.

6. The paint ball gun cleaning device of claim 2, wherein the second end of the cleaning tip adaptor member is configured to adequately secure a flag or a cotton towel when used for cleaning the inside barrel.

7. The paint ball gun cleaning device of claim 1, wherein the outer tube and the inner tube have at least one flexible but sufficiently rigid section permitting the paint ball gun cleaning device to flexibly fold but otherwise be stiff enough to be pushed through the inside barrel when not folded.

8. The paint ball gun cleaning device of claim 7, where in at least one inner tube section corresponding to the at least one flexible section of the outer tube is replaced with a monofilament line that connects the inner tube sections not substantially corresponding to the flexible outer tube section.

9. The paint ball gun cleaning device of claim 1, wherein the first compressible cleaning tip is a spherical rubber ball.

10. The paint ball gun cleaning device of claim 1, wherein the outer tube and inner tube are made of a malleable material that may be cut to an arbitrary length, using common cutting tools, and remain operable for their intended purpose.

11. The paint ball gun cleaning device of claim 10, wherein the malleable material is plastic.

12. A paint ball gun cleaning device for cleaning an inside barrel of a paint ball gun, the cleaning device comprising:

a. An outer tube having a first end and a second end, wherein the diameter of the outer tube is configured to permit the outer tube to be removabley inserted along the length of the inside barrel of the paint ball gun;

b. An inner tube having a first end and a second end, wherein the diameter of the inner tube is configured to permit the inner tube to be movabley inserted along the length of the outer tube, wherein the outer tube and the inner tube have at least one flexible but sufficiently rigid section permitting the paint ball gun cleaning device to flexibly fold but otherwise be stiff enough to be pushed through the inside barrel when not folded;

c. A first compressible cleaning tip having a smaller diameter than the inside barrel, and further having at least a non-compressed state and a compressed state, the non-compressed state having a corresponding non-compressed diameter, and the compressed state having a corresponding compressed diameter, wherein the compressed diameter is greater than the non-compressed diameter; and d. A cleaning tip compression member having a smaller diameter than the inside barrel, and further having a first end and a second end, wherein the second end of the cleaning tip compression member is in communication with the first end of the inner tube and constrains the position of the first compressible cleaning tip in the proximity of the first end of the outer tube, the cleaning tip compression member is further configured to be in communication with the side of said first compressible cleaning tip that is distal from the inner tube, and may be actuated to induce a compression state change in the first compressible cleaning tip when the inner tube is moved relative to the outer tube, thereby selectively inducing the non-compressed state and the compressed state.

13. The paint ball gun cleaning device of claim 12, further comprising:

e. A cleaning tip adaptor member having a first end and a second end, wherein the first end of the cleaning tip adaptor member is in communication with the second end of the inner tube; and f. A second compressible cleaning tip for cleaning the inside barrel, which second compressible cleaning tip is in communication the second end of the cleaning tip adaptor member.

14. The paint ball gun cleaning device of claim 13, further comprising:

A removable protective sleeve sufficiently covering the cleaning tip adaptor member to substantially prevent harmful contact with the inside barrel and to provide some degree of rigid support between the cleaning tip adaptor member and the second compressible cleaning tip.

15. The paint ball gun cleaning device of claim 12, where in at least one inner tube section corresponding to the at least one flexible section of the outer tube is replaced with a monofilament line that connects the inner tube sections not substantially corresponding to the flexible outer tube section.

16. A paint ball gun cleaning device for cleaning an inside barrel of a paint ball gun, the cleaning device comprising:

a. An outer tube having a first end and a second end, wherein the diameter of the outer tube is configured to permit the outer tube to be removabley inserted along the length of the inside barrel of the paint ball gun;

b. An inner tube having a first end and a second end, wherein the diameter of the inner tube is configured to permit the inner tube to be movabley inserted along the length of the outer tube, wherein the outer tube and inner tube are made of a malleable material that may be cut to an arbitrary length, using common cutting tools, and remain operable for their intended purpose, c. A first tip means for cleaning the inside barrel, said first barrel cleaning means having at least a non-engaged state and an engaged state; and d. A cleaning tip engagement member having a smaller diameter than the inside barrel, and further having a first end and a second end, wherein the second end of the cleaning tip engagement member is in communication with the first end of the inner tube and constrains the position of the first barrel cleaning means in the proximity of the first end of the outer tube, the cleaning tip engagement member is further configured to be in communication with the side of said first barrel cleaning means that is distal from the inner tube, and may be actuated to induce a engagement state change in the first barrel cleaning means when the inner tube is longitudinally retracted relative to the outer tube, thereby selectively inducing the non-engaged state and the engaged state.

* * * * *

UNITED STATES PATENT AND TRADEMARK OFFICE

CERTIFICATE OF CORRECTION

PATENT NO. : 7,055,279 B2
APPLICATION NO. : 10/764033
DATED : June 6, 2006
INVENTOR(S) : Jimmy Flores It is certified that error appears in the above-identified patent and that said Letters Patent is hereby corrected as shown below:

On Title Page; Item (57) Col.2

IN THE ABSTRACT DESCRIPTION
IT SHOULD READ

A DEVICE AND METHOD FOR CLEANING AN INSIDE BARREL OF A PAINTBALL GUN IS PROVIDED. THE CLEANING DEVICE COMPRISES A COMPRESSIBLE CLEANING TIP CONFIGURABLE TO HAVE A SMALLER DIAMETER THAN THE INSIDE BARREL IN RESPONSE TO A COMPRESSION MEMBER, THE TIP BEING MOUNTED TO AN END OF AN ELONGATED TUBE. THE INSIDE OF THE PAINTBALL GUN BARREL IS CLEANED BY INSERTING THE CLEANING DEVICE WHILE DECOMPRESSED, AND RETRACTING IT IN ITS COMPRESSED AND ENLARGED STATE.

Signed and Sealed this

Twenty-sixth Day of September, 2006

JON W. DUDAS
*Director of the United States Patent and Trademark Office*